US005372403A

United States Patent [19]

Puerto

[11] Patent Number: 5,372,403

[45] Date of Patent: Dec. 13, 1994

[54] ARMREST WRITING SURFACE HAVING ADJUSTABLE ANGLE

[76] Inventor: Juan R. Puerto, 1452 Claret Ct., S.W., Fort Myers, Fla. 33919

[21] Appl. No.: 792,587

[22] Filed: Nov. 15, 1991

Related U.S. Application Data

[63] Continuation-in-part of Ser. No. 551,650, Jul. 9, 1990, abandoned.

[51] Int. Cl.[5] ..... A47C 7/68

[52] U.S. Cl. ..... 297/188.17; 297/145; 312/311; 312/313

[58] Field of Search ..... 297/194, 188, 145; 312/311, 313, 233; 108/43; 40/145

[56] References Cited

U.S. PATENT DOCUMENTS

| | | | |
|---|---|---|---|
| 554,452 | 2/1896 | Munich | 312/233 |
| 1,180,750 | 4/1916 | Wolf | 312/233 |
| 1,870,553 | 8/1932 | Bullen | 312/233 |
| 2,272,819 | 2/1942 | Poetsch et al. | 312/313 |
| 3,083,998 | 4/1963 | Morris | 297/194 |
| 4,082,386 | 4/1978 | Beasley, Jr. | 312/313 |
| 5,074,617 | 12/1991 | Maxwell | 297/194 |
| 5,076,641 | 12/1991 | Lindberg | 297/194 |
| 5,106,153 | 4/1992 | Durling | 297/194 |

FOREIGN PATENT DOCUMENTS

| | | | |
|---|---|---|---|
| 375 | 2/1864 | United Kingdom | 312/311 |
| 10792 | 6/1894 | United Kingdom | 312/233 |

*Primary Examiner*—James R. Brittain
*Assistant Examiner*—Cassandra Davis
*Attorney, Agent, or Firm*—Julian C. Renfro

[57] ABSTRACT

An armrest provided with a writing surface for a seated user, such armrest being of narrow, elongate construction and having a rear end, a front end, an interior portion and an upper portion. A usable surface of elongate configuration is disposed in the upper portion of the armrest, with this usable surface being supported in a manner enabling the usable surface to be slidably withdrawn from the front end of the armrest, and thereafter to be returned at the option of the user to a retracted location in the interior of the armrest. The usable surface is unimpaired as a writing surface by virtue of the slidable mounting for this member being located on the underside of the usable surface. A tiltable writing surface may be hingedly mounted on the usable surface, with the tiltable writing surface having a device thereon by which writing material can be removably attached to the tiltable writing surface. An advantageous arrangement is provided for supporting the tiltable writing surface in a desired angular relationship to the usable surface, latter arrangement enabling the user to select the particular angle at which a writing pad or other such writing material can be maintained. A storage container may be utilized in the interior of the armrest, with a hinged lid forming the cover for the storage container. In the preferred embodiment, the usable surface is slidably mounted in the interior of the hinged lid.

27 Claims, 7 Drawing Sheets

FIG 1
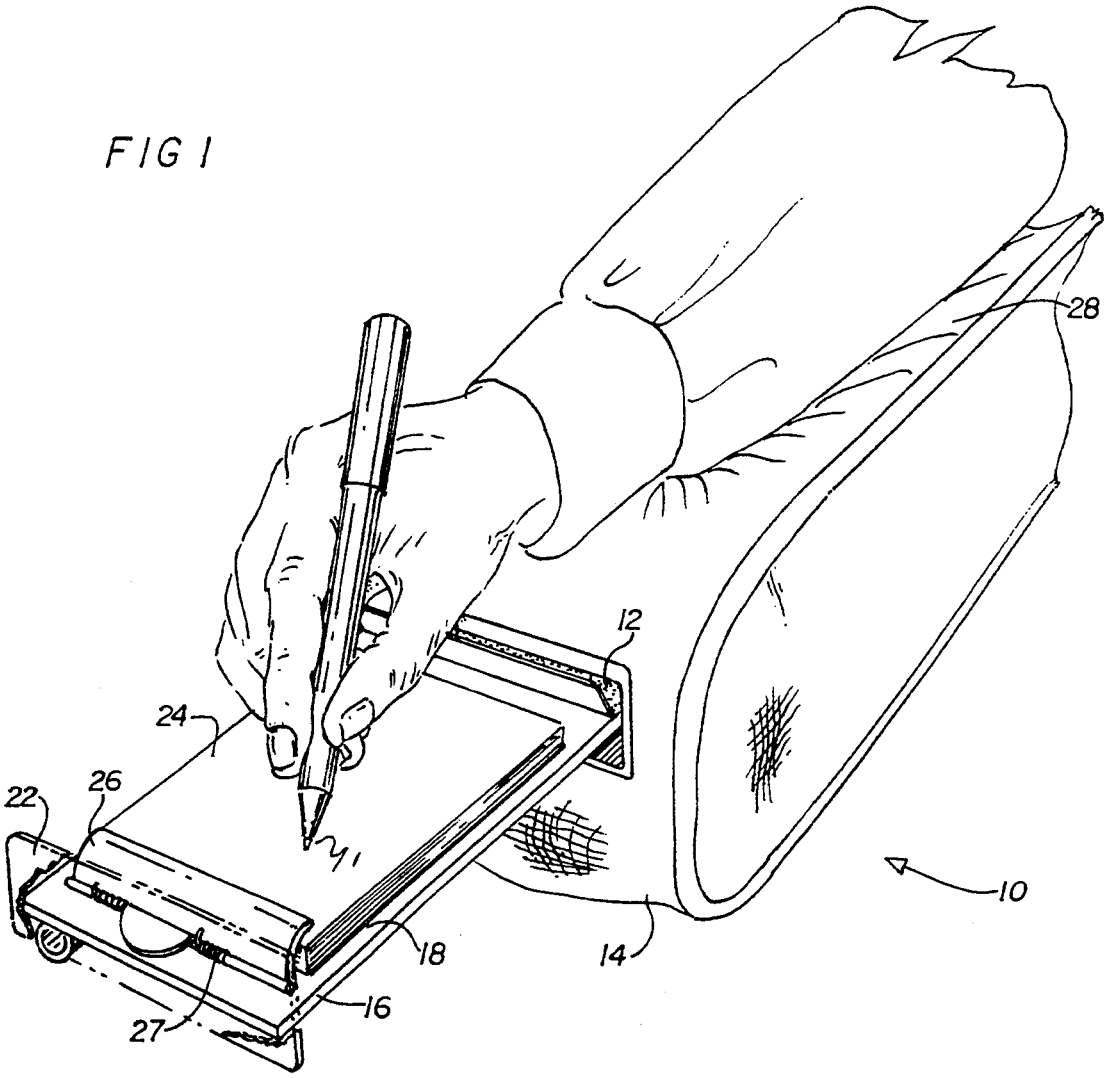
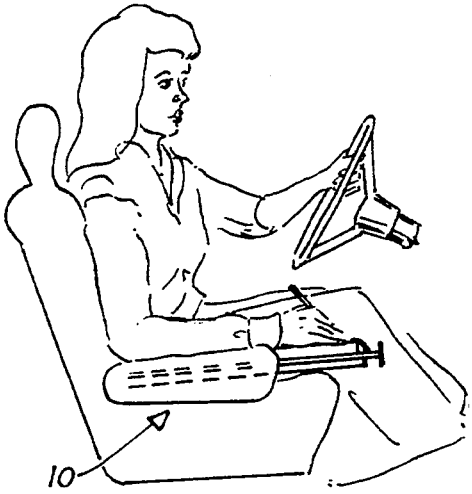
FIG 2

FIG 3
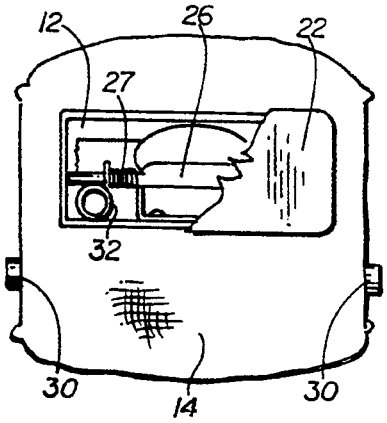
FIG 6
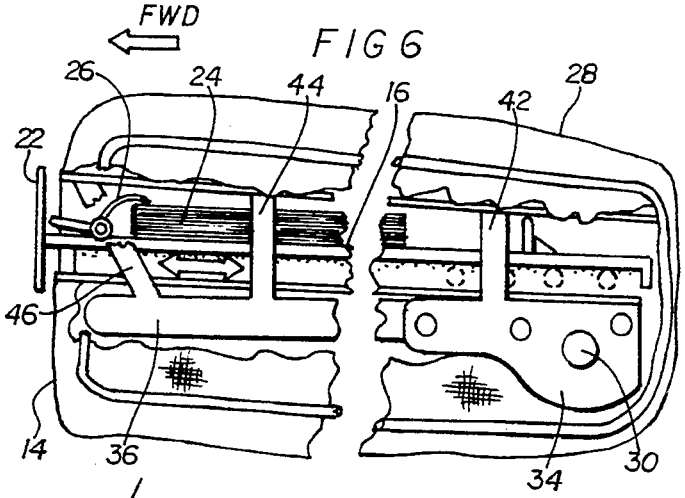
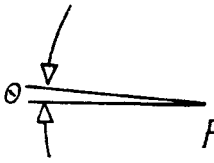
FIG 6a
FIG 4
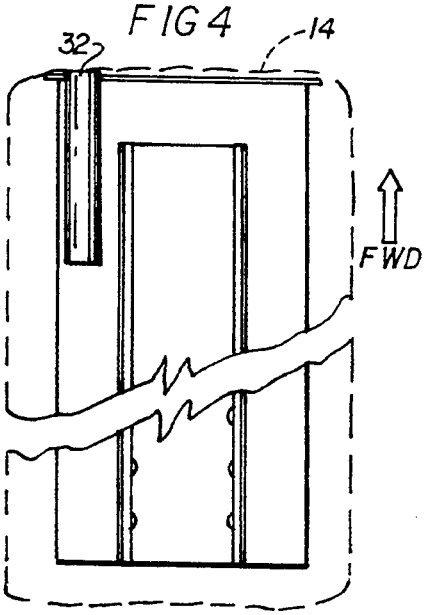
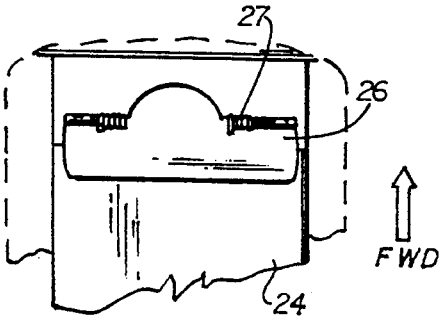
FIG 5
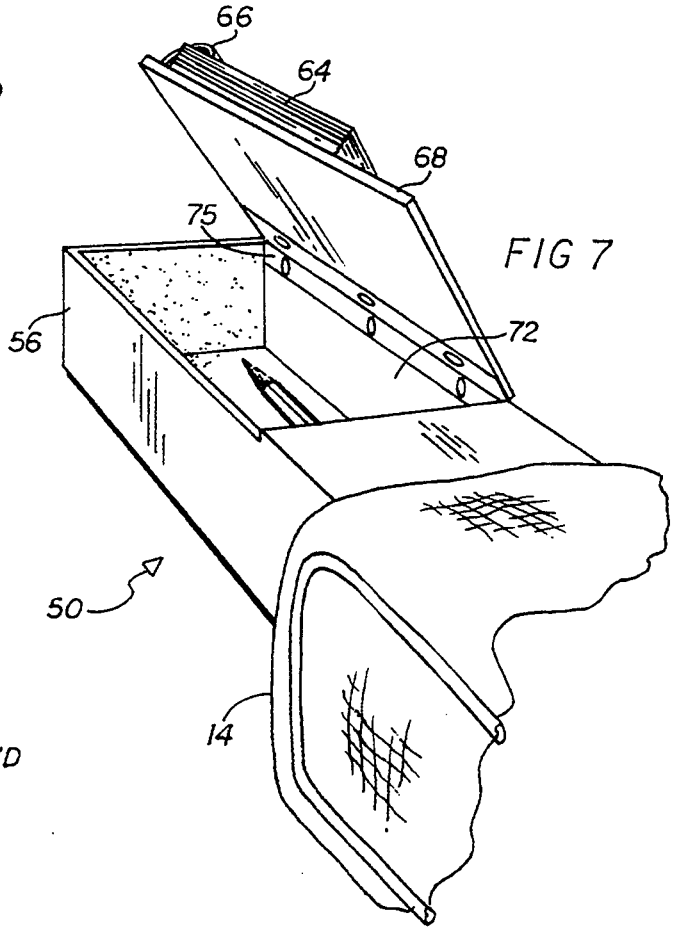
FIG 7

FIG 8
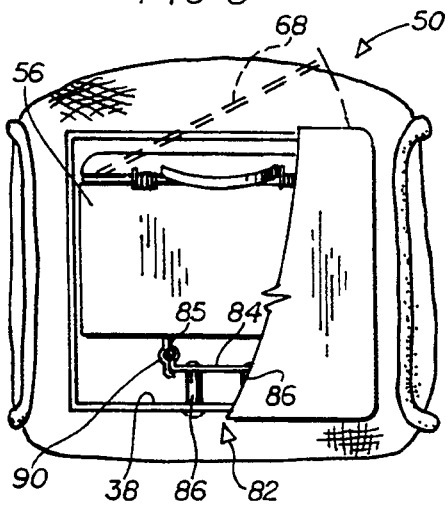
FIG 10
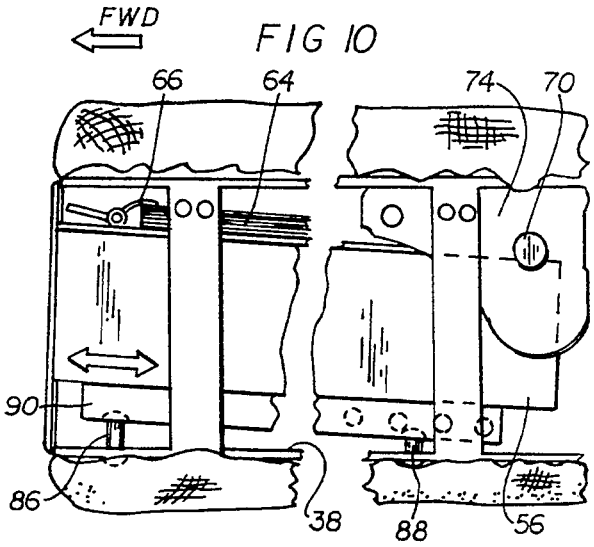
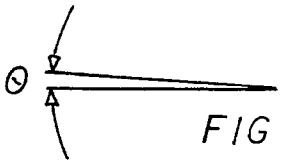
FIG 10a
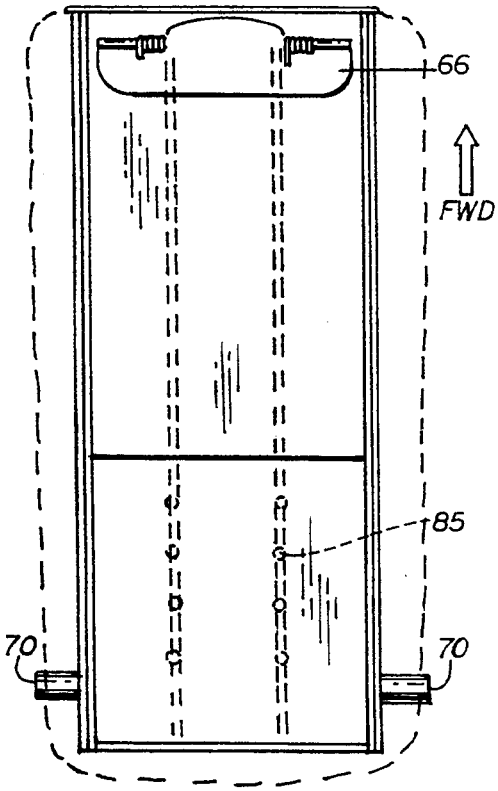
FIG 9
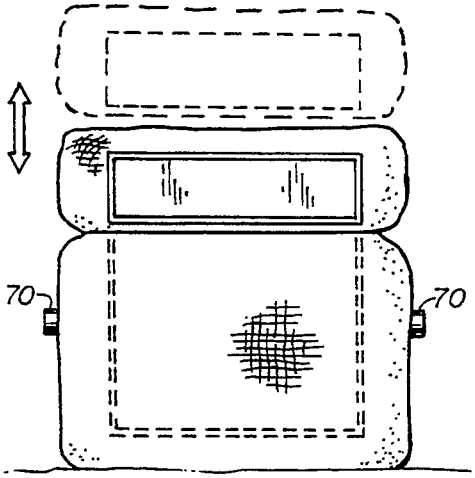
FIG 11

ARMREST WRITING SURFACE HAVING ADJUSTABLE ANGLE

RELEATIONSHIP TO PREVIOUS INVENTION

This may be regarded as a continuation-in-part of my pending application entitled "TILTABLE ARMREST HAVING ADJUSTABLE WRITING SURFACE," Ser. No. 07/551,650, now abandoned, filed Jul. 9, 1990, which is being abandoned with the filing of this application.

BACKGROUND OF THE INVENTION

The present invention principally relates to a usable surface designed to support a writing pad or the like, with this usable surface preferably being incorporated into an armrest utilized in a vehicle.

Often creative people, such as writers, inventors and some members of the noble professions, as they ride along in an automobile, visualize certain concepts and solutions to problems with which they are confronted, and in such instances, such persons need to have means for capturing those ideas, concepts and solutions, before they slip out of reach and become lost.

Other people riding in an automobile tend to think over the activities of the day or their financial obligations, and in doing so it becomes desirable for them to make a list of things to be done the next day, or later in the week.

I am aware that others have designed tables for use in automobiles, and one example is U.S. Pat. No. 2,797,739 to Orsini entitled "Combined Arm Rest, Table and Drawer for Vehicle Seats," which was issued Jul. 2, 1957. That patent taught the use of a table carried in a vehicle armrest, but rather unfortunately, the mechanism that patentee uses for the support of the slidably mounted table is configured such that it may well interfere with the use of a writing pad thereon. In addition, it is necessary for the table used by Orsini to be turned 90° before it can be used.

The Kathiria U.S. Pat. No. 4,453,759 entitled "Floor Console With Latchable Sliding Tray" teaches an article-carrying tray member that can be slid forwardly out of a floor console located in the front passenger space of an automobile. The tray member is described as having two bores for receiving beverage containers. This patentee says nothing about having means for supporting a writing surface, nor is any storage space provided in the device. Also, the tray is slidable between upper and lower internal walls 34 and 36 that would prevent a writing pad from remaining on the surface of the tray after it has been pushed back into the console.

Another example of portable table for use in vehicles is to be found in U.S. Pat. No. 3,326,446, which issued to H. Goings on a portable car seat tray formed from a single sheet of folded cardboard. The tray has legs provided with a seat matching contour and also has receptacles for food and beverage containers. U.S. Pat No. 3,632,158, which issued to A. Boothe, discloses a console designed to be supported on a vehicle seat, whereas U.S. Pat. No. 4,087,126 to L. Wynn discloses a console for van-type vehicles, with receptacles for beverage containers.

The Hawie U.S. Pat. No. 3,951,448 teaches a receptacle armrest requiring a recess or pocket in the backrest of the seat, to permit the armrest to be tilted. A tray with upstanding sidewalls is set forth in U.S. Pat. No. 4,341,418, to A. Chappell, which discloses a car seat table capable of being stored under a car seat. The table of the Chappell patent is constructed from three sections connected to one another by hinges. The table is held in an upside-down storage position by guide runners centrally positioned in alignment on each table section and which slides along a track mounted on the bottom of the car seat for storage. The tray is provided with a plurality of apertures for receiving beverage containers and has a flat table top portion with opposed upstanding sidewalls.

U.S. Pat. No. 4,010,696, to H. Priesman, discloses a tray for use in an automobile which is fitted on its underside with folding legs, of a size which, when extended, mount the tray on the floor inside a vehicle over the hump of the transmission shaft. The tray has receptacles for accommodating food and beverage containers, and has a flat table top portion surrounded by upstanding sidewalls. U.S. Pat. No. 3,922,973 to H. Sturgeon, discloses a portable automobile desk for use in vehicles. The vehicle desk is provided with attaching brackets and straps to secure the desk to the wire frame of the underside of the seat.

The Barrett U.S. Pat. No. 2,016,571 relates to a desk having a top portion which is adjustably tiltable and which is forwardly and rearwardly adjustably slidable. The Barrett, however, does not teach a slidable drawer which may be tucked completely away when not in use. Also, the tiltable surface cannot be used as an armrest inasmuch as book supporting edge 46 would be an unpleasant obstacle upon which to rest an arm. Although a book could be rested on the tiltable surface of the Barrett device, this patent does not teach a tiltable surface upon which a writing pad could be conveniently secured, upon which the user could easily write.

All of these previous arrangements for providing a table that theoretically could be used in a vehicle have distinct disadvantages insofar as being an ideal writing surface.

There also exists a variety of cup holders or container holders utilized for supporting cups, cans and other beverage containers in a vehicle such that the vehicle occupants can support such beverage containers while in the vehicle. U.S. Pat. No. 4,417,764 issued Nov. 29, 1983 is representative of one cup holder structure which is incorporated in the armrest of a vehicle and which can accommodate such containers. U.S. Pat. No. 3,326,445 discloses a disposable container holder for use on a car seat. U.S. Pat. Nos. 3,497,076 and 4,040,659 also disclose cup holders which move from a storage position within a support structure in an automobile to a use position.

With regard to foreign art, German Patent No. 3,807,880 teaches an armrest with a slidable lid, but such is clearly not a tiltable armrest console.

Although such various cup holders are useful for single or limited sized containers, the system of the present invention is adapted to accommodate a variety of different sized beverage containers such as cans, coffee mugs, large cups and the like.

In addition to providing distinct improvements upon these prior art devices, other important objects of this invention are to provide a useful armrest configuration which may have one or more drawers to contain writing materials, maps, and the like, the attachment being highly integrated in construction and easily installed in a vehicle in a secure and comfortable position.

Further important objects and advantageous features of the instant invention will be apparent from the following description and the accompanying drawings, wherein, for purposes of illustration rather than limitation, certain specific embodiments of the invention are set forth in detail.

SUMMARY OF THE INVENTION

A tiltable armrest for a vehicle in accordance with this invention is primarily provided for the benefit of a seated user, and comprises at least one usable surface able to be slidably withdrawn from the armrest for use with a writing tablet or the like. My armrest is of a narrow, elongate construction, having a rear end as well as a front end, and an interior portion. Some embodiments of my armrest have a hinge or pivot adjacent the lower portion of the armrest, at the rear end thereof. This arrangement enables the armrest to be pivoted upwardly on occasion, and thereafter returned, when desired, to the downwardly disposed, active position.

An end panel is located at the front end of the armrest, at a location remote from the hinge or pivot. The usable surface has attachment means thereon, such that upon the usable surface being slidably withdrawn from the front end of said armrest, a writing tablet or pad disposed upon the usable surface can then be utilized for some utilitarian purpose. Significantly, I use sufficient clearances with respect to the usable surface that the writing tablet can remain on the usable surface at the time the surface is being reinserted into the armrest.

Several embodiments of devices usable as writing surfaces are set forth in accordance with this invention, and certain of these embodiments permit various adjustments of height and angularity. Some preferred embodiments involve the writing pad supporting surface being hingedly mounted so that the user can place it at an angle deemed most appropriate for his or her purposes.

The armrest may be large enough to contain ample storage means for items likely to be needed from time to time by a motorist, and certain embodiments of my invention involve the use of a plurality of slidable drawers in the armrest, upon which devices such as telephone, dictation equipment and the like can be contained.

In the embodiments of my invention utilizing a storage container in the interior of the armrest, I utilize a hinged lid of elongate configuration as the closure means for the container. In the preferred embodiment of my invention, the hinge means supporting the lid is disposed on the long side of the lid farthest from the user. However, another embodiment of my invention utilizes the hinge means supporting the lid at the rear surface of the lid. In both of these embodiments, the lid contains a slidably mounted usable surface that the user can slide out of the lid when he or she wishes to use a writing surface. After use, the usable surface can be readily returned into the interior of the lid.

It is therefore a principal object of this invention to provide an armrest for the seated user, from which an elongate surface admirably suited for writing and note taking can be slidably withdrawn and utilized as needed, with the angularity of the writing surface being adjustable to suit the individual requirements and tastes of the user.

Another object is to provide a usable surface disposed in an armrest and able to be slidably withdrawn, when needed, with the usable surface being unimpaired as a writing surface by virtue of the support for the usable surface being entirely located on the underside thereof.

It is yet another object of my invention to provide a pivotally mounted armrest able to contain a writing surface upon which a writing tablet may be comfortably and effectively used, one or more drink holders, and in some embodiments, suitable compartmentation utilized, which is designed to permit the convenient storage of other items likely to be needed from time to time by the motorist.

It is still another object of my invention to provide an armrest having the capability of housing a slideout writing surface as well as having one or more pivotally mounted drink holders, with the drink holders being able to be swung laterally on occasion, and therefore usable in a manner not interfering with the contemporaneous use of the writing surface.

It is yet still another object of this invention to provide an armrest that accommodates a highly satisfactory writing surface whose angularity and position can be carefully adjusted for the convenience of the user, and which armrest can also contain a multiplicity of slidable shelves adapted to house various ancillary devices particularly needed from time to time by a motorist.

It is yet another object of my invention to provide a writing surface located in an armrest in which the support means permitting the slide out—slide back in features of the writing surface are utilized on the underside thereof, thus permitting the ready withdrawal of the writing surface from the armrest on occasion, with such utilization of the support means on the underside of the writing surface enabling the usable portion of the writing surface to be maximized.

These and other objects, features and advantages will become more apparent from a study of the appended drawings.

BRIEF DESCRIPTION OF THE DRAWINGS

FIG. 1 represents a first illustrative embodiment of my invention, showing how the driver can pull out and utilize a writing pad mounted upon a firm, but retractable mounting surface, which is entirely concealed when retracted;

FIG. 2 is an illustrative depiction of a person in an automobile driver's seat, with this first embodiment of my invention showing the writing surface extended and placed in use;

FIG. 3 is a front elevation of the front end of a first embodiment of my invention, showing how the writing surface can be entirely retracted into a standard size automobile armrest, and concealed by a retractable cover;

FIG. 4 is a plan view of the underside of the first embodiment of my retracted "desk," revealing how the uppermost part of the writing surface is maintained clear by locating the slider mechanism or mounting member on the underside of the writing surface, with this figure also revealing a writing instrument holder attached to the device;

FIG. 5 is a partial plan view of the top or working surface of the first embodiment of my invention, with the dashed lines indicating the cloth armrest surface, with a spring clip used to hold securely a pad of paper being illustrated;

FIG. 6 is a side elevation of the first embodiment of my invention, with the slidable writing surface in its stowed or retracted position, with a pad of paper in its clip;

FIG. 6*a* shows the angle I have provided in consideration of the ergonomics of the user, which angle is applicable to all embodiments of my invention;

FIG. 7 is a perspective illustration of the second embodiment of my invention, with the writing surface in its extended and tilted position, revealing the function of the incorporated storage unit, and illustrating how a pad of paper may be retained on the writing surface by a clip;

FIG. 8 is a front elevation of the second embodiment of my invention;

FIG. 9 is a plan view of the second embodiment of my invention, illustrating the pivot means at the rear, and utilizing dashed lines to indicate the position of its slider mechanism, which may utilize ball bearings;

FIG. 10 is a cutaway side elevation of the second embodiment of my invention, showing by means of spacers how I have accommodated an ergonomically correct angle into its design;

FIG. 10*a* is view akin to FIG. 6*a*, relating to the angle I have built into my device, in consideration of the ergonomics of the user;

FIG. 11 is a front elevation of the third embodiment of my invention, wherein the lower dashed lines indicate the position of the integrally incorporated storage container, and wherein the upper dashed lines indicate the writing surface member in a raised, supported position;

DETAILED DESCRIPTION

Figure 12:
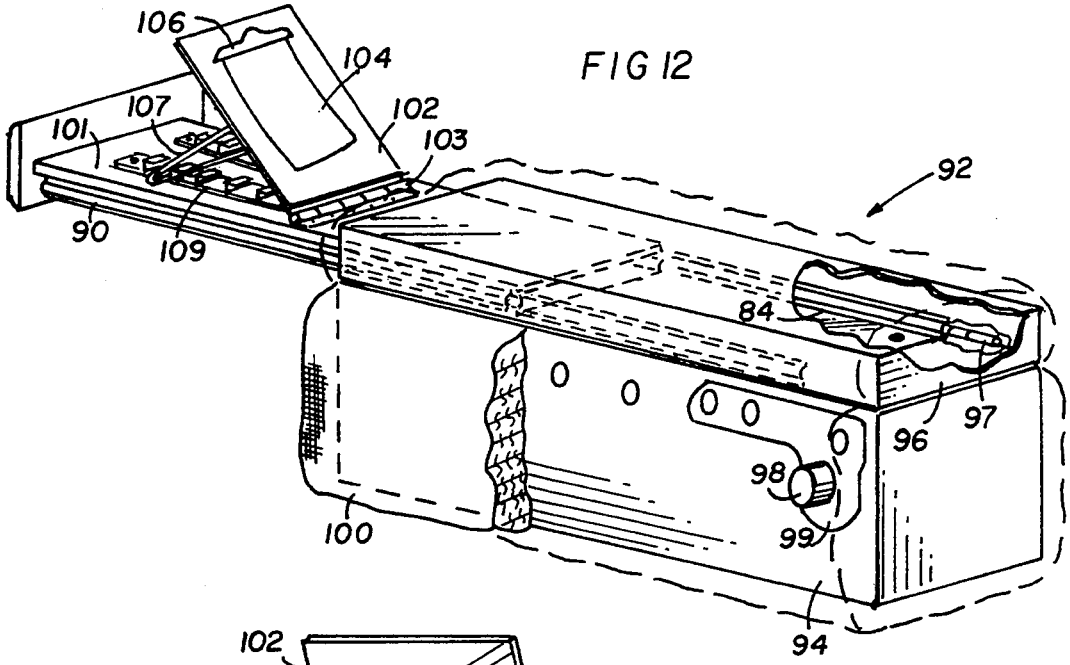
FIG. 12 illustrates a preferred embodiment of my novel armrest, equipped with a lid or cover member hinged along its longitudinal edge, which cover member contains a slidably disposed usable surface, upon which a tiltable writing surface is hingedly supported, to serve as a support for a writing pad.

With initial reference to FIG. 1, it will there be seen that I have shown an exemplary version of an armrest 10 providing a writing surface for the convenience of a seated passenger. As will be noted from this figure, the armrest 10 is of elongate configuration, and it has an opening 12 provided in its forward portion 14.

Slidable in and out of the opening 12 is a relatively long, narrow drawer 16, that the user can move from the stored position into the extended position, or vice versa, quite easily. Removably mounted on the usable upper surface 18 of the drawer 16 is a writing pad 24, that is held in the desired position by a spring clip 26. A torsion spring 27 is normally utilized in connection with the clip 26, so that the pad 24 will be secured tightly to the upper surface 18 of the drawer 16.

As will be discussed at greater length hereinafter, the drawer support means, including suitable runners or sliders, is disposed on the underside of the drawer 16, so as to make possible an entirely unencumbered upper drawer surface 18, which I may also refer to as a usable surface or as a surface for supporting writing material.

At the forwardmost end of the drawer 16 is a closure member or lid 22, that serves a plurality of purposes. First of all, the closure member 22 serves the purpose of making the opening 12 virtually inconspicuous when the drawer 16 is in the closed position. Secondly, the closure member forms a handle of sorts, to aid the user in grasping the drawer, in order to move it from the closed position into the open, or usable position.

As is obvious from FIG. 1, the seated user can place his or her arm on the padded upper surface 28 of the armrest 10, and then proceed from this comfortable location to write letters, memos, reminders or the like on the writing pad or tablet 24.

FIG. 2 reveals a bit more clearly how my armrest 10 is configured for the convenience of the seated user.

As will become more obvious as the description proceeds, a number of different armrest configurations are within the scope of my invention, and in FIG. 3, I show a view of the forward portion 14 of the armrest, with the drawer 16 at this point residing in a stored position therein. An important feature of this as well as the other embodiments of my invention is the placement of the slider mechanism on the underside of the drawer, so as to leave the upper surface of the drawer flat and clear of the components normally associated with a slider mechanism.

As mentioned hereinabove, the closure member or lid 22 provided at the outermost end of the drawer 16 is configured to provide an attractive appearance for the armrest when the drawer has been moved to the stored position, or in other words, the closure member 22 serves to make the opening 12 less noticeable.

In most embodiments of my invention, my armrest is pivotally mounted about a point located at the rear end of the armrest. In FIG. 3 I show aligned, oppositely extending members 30 representing the location about which the user can cause the armrest 10 to pivot.

It is to be noted that as an alternative to the use of the pivot members 30, I may use on each side of the armrest, a type of hinge utilizing teeth along one part or portion of each hinge half, with the teeth of the two hinge halves being in engagement during normal use of the device. This type of hinge has the characteristic of causing the armrest to be supportable in any one of a number of selected positions or angles of inclination; note FIG. 19.

In FIG. 3 the closure member 22 is broken away to reveal the utilization of a generally cylindrical storage member 32 in which writing implements, including pencils, pens or other such elongate items may be readily stored.

In FIG. 4 I provide a view taken from below of this first embodiment of my armrest, with it to be understood that the forward end 14 of the armrest 10 is the end toward the top of this figure of drawing. To be seen in this figure is the generally cylindrical member 32 into which pencils, pens or other such items may be readily inserted and stored. The member 32 is located below the plane of the drawer 16. The mechanism for slidably supporting the drawer may utilize ball bearings, but I am not to be limited to such usage.

Fragmentary FIG. 5 shows the forward end of the upper surface of the armrest in some detail, with the spring clip 26 being particularly noticeable in this figure. Because the spring or springs 27 used on the clip are fairly strong springs, it can be expected that the writing pad 24 can be held firmly in the desired position, without the pad being disturbed from such desired position on the drawer as a result of the drawer being moved between the extended and the retracted or folded positions, nor disturbed by the subsequent tilting of the armrest. In other words, I provide a sufficiently large interior in the upper portion of the armrest such that it is unnecessary for the writing pad to be removed.

FIG. 6 is a side elevational view revealing some of the desired structure involved in my invention, and it will be noted that in this figure, some of the metal components utilized for supporting the drawer are depicted. The previously mentioned, outwardly extending hinge member or pivot member 30 of the armrest appears in the lower right corner of FIG. 6. As made clear in this figure, the pivot member 30 is supported on a somewhat "L" shaped member 34, to which a longitudinal member 36 is riveted or otherwise secured. The longitudinal member 36, and a comparable member on the opposite side of this embodiment of my armrest, serve to support a member 38 upon which the support means of the slidable drawer 16 are mounted.

Extending upwardly from the member 34 is a vertical member 42, and extending upwardly from the longitudinal member 36 are vertical members 44 and 46. These three vertical members are of similar length, and serve, with three similar if not identical vertically extending members on the opposite side of the armrest, to support the generally planar structural member (not shown) that supports the padded upper surface 28 of the armrest.

Also visible in FIG. 6 is the slidable drawer 16, as well as the pad of paper 24 that is held firmly in place by the spring powered clip 26. Additionally shown are some of the members or components directly concerned with the slidable support of the drawer 16.

I typically mount the slidable drawer 16 on runners that are directly supported from the longitudinally extending support member 38, best seen in the embodiment illustrated in FIGS. 8 and 10. Because of the effective use of proper drawer support means, no substantial hindrance is formed with regard to desired in and out motion of the drawer 16.

Instead of having the drawer 16 being located precisely in a horizontal plane, I prefer to dispose the drawer at a small upward angle, slightly noticeable in FIG. 6, with the clip end of the drawer being higher than the end of the drawer nearest the pivot 30. The amount of up angle typically employed is depicted schematically in FIG. 6*a*.

In FIG. 7 I reveal a second embodiment 50 of my invention, involving a drawer member 56 of a different configuration than the drawer member 16, in that the drawer 56 has considerable depth. Instead of the writing pad 64 being mounted on a member that can only be slid in and out of the armrest, the writing pad 64 shown in FIG. 7 is mounted on what may be regarded as closure member 68, that is hingedly mounted by means of a piano type hinge 75 on the edge of the drawer or storage receptacle 56. Because of this construction, a storage location 72 can be formed below the closure member 68, into which storage location a large number of items can be carried. Not only can these items be in the nature of pens and pencils, but also they could include the use of spare writing pads, sunglasses, sunblocker, as well as other components in which driver and/or his passenger would have an interest. For example, the storage area 72 located below the writing surface 68 of the drawer 56 may be large enough to readily accommodate other items such as an ice scraping device for use on the windshield, items for the driver's personal defense, and the like.

In FIG. 8 I reveal a front elevational view taken from the front end of the armrest 50, to reveal the rather substantial depth possessed by this embodiment of the drawer 56 or storage compartment in accordance with my invention. It will be recalled that in this embodiment, the member 68 forming the upper surface of the storage compartment 72 is hingedly mounted, with dashed lines being utilized to reveal an intermediate location of the closure member 68.

Also in FIG. 8 I reveal a typical mounting means 82 for the slidable storage compartment 56, with this entailing a generally U-shaped member 84 mounted upon two pairs of standoffs, with only the pair of front standoffs 86 being visible in this figure. The member 84 is supported by member 38, and the member 84 serves as a fixed rail upon which the rather large drawer 56 is slidable between extended and retracted positions.

With reference to FIG. 10 it will be seen that a front standoff 86 and a rear standoff 88 are both visible, with the front standoff being noticeably longer than the rear standoff that is utilized to support the rear end of the U-shaped member 84. As a result of this construction, the rear end of the compartment 56 revealed in FIG. 10 is somewhat lower than the front end, meaning that the compartment will normally return easily under the influence of gravity to the stored position, in which it has been retracted into the interior of the armrest. Because the compartment is normally closed on all sides, nothing is lost at the time the user may decide to tilt the armrest.

A number of balls or spheres 85 may be mounted between the inner rail members 84, and the outer rail members 90. These balls or spheres 85 are indicated in FIG. 9, and although this construction is preferred, I am not to be limited to this arrangement.

The outer rail members 90 are affixed along the underside of the drawer 56, and disposed on the longitudinal centerline of the drawer. This advantageous construction makes the inward and outward slidable movements of the large drawer 56 relatively easy to bring about.

FIG. 9 is a view from above of this second embodiment of my armrest, with the spring clip 66 shown nearest the front end of the armrest, and the pivot members 70 representing the point about which rotation of the armrest is brought about.

In FIG. 10 I reveal a side elevational view of the embodiment of FIG. 7, with the writing pad or tablet 64 shown in a secured location atop the drawer or compartment 56, with the pivot member 70 mounted upon generally L-shaped member 74. As previously mentioned, I provide ample clearance in the upper part of my novel armrest, so that the pad 64 and the clip 66 can be readily accommodated. Obviously, a corresponding pivot member and L-shaped member are utilized on the opposite side of the armrest embodiment 50.

In FIG. 10*a*, I reveal the preferred amount of angularity for the second embodiment of my device, whereas in FIG. 11 I show an end view of an embodiment to be discussed shortly. In FIG. 11 I reveal by the use of dashed lines, the raised position of the upper surface of the armrest at the time the writing surface is to be utilized, with this figure also revealing the pivot members 70 about which the armrest can be pivoted.

With reference now to FIG. 12, it will be seen that I reveal a preferred embodiment 92 of a tiltable armrest in accordance with this invention. This embodiment is to be seen to involve a compartment 94 in which items such as writing implements, writing pads, sunglasses, maps and the like can be stored. Closure member or lid 96 is of elongate configuration, being approximately the same size as the upper surface of the compartment 94, and in this embodiment, the closure member 96 is supported by hinge 97. In FIG. 12, the hinge 97 is on one of the long sides of the closure member, in this instance being on the far side of the device. Therefore, the hinge 97 is only partially visible in this figure.

The armrest is tiltable about pivotal support 98 and an identical pivotal support on the far side, not visible in this figure. Both of these pivotal supports are in turn supported from L-shaped members 99 that are secured in aligned relation on both sides of the compartment 94. Only one of these L-shaped members 99 is to be seen in FIG. 12.

The exterior of the compartment 94 is covered by padding 100. Preferably the upper exterior surface of the closure member 96 is padded for comfortably supporting the arm of the user.

Continuing with FIG. 12, I provide a pull-out drawer or usable surface 101 of the type described hereinbefore, which drawer is slidably mounted in the interior of the closure member or lid 96 by the use of a rail member 90. The user can pull out the drawer to whatever distance he or she finds convenient, and after use, return it to the stowed position in the lid. A closure member 22 may be located on the outer end of the drawer 101.

Tiltable member 102 is a writing surface mounted by hinge means 103 to the upper or usable surface of the pull-out drawer 101, with the arrangement being such that the angularity of the tiltable member 102 can be readily altered to suit the needs of the particular user. I typically utilize a writing pad or tablet 104 on the upper surface of the tiltable writing surface 102, held in place by a spring biased clip means 106 that is secured to the upper edge of the tiltable member. This type of clip means has been discussed hereinbefore. As is obvious, by pressing on the rounded upper edge of the clip 106, the bias of the spring of the clip can be overcome such that an exhausted pad can be removed and a new pad added.

Figure 13:
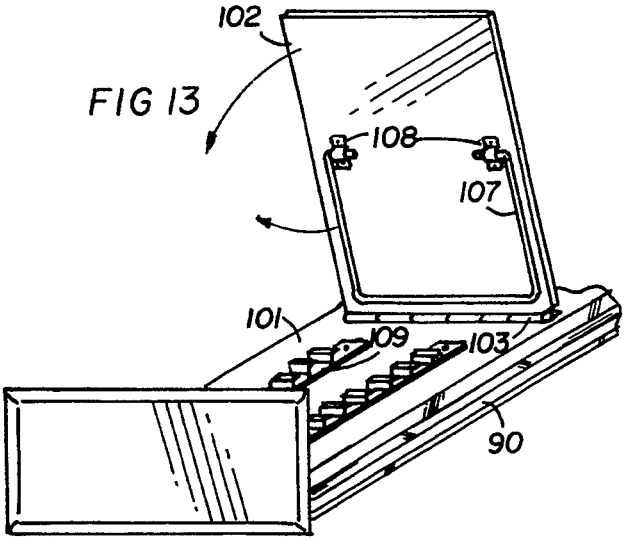
FIG. 13 is a view from the rear side of the tiltable writing surface, revealing the means by which its angularity can be adjusted.

With reference to FIG. 13, I there reveal the backside of the tiltable writing surface 102, and it will be seen that a U-shaped member 107 is attached to the rear side of the tiltable member by means of a pair of hinges 108 that are utilized in an aligned relationship. By virtue of this arrangement, the U-shaped member 107 can be folded flat against the backside of the tiltable writing surface 102 when the surface is to be moved to the flattened condition so that the pull-out drawer 101 can be slid back inside the interior of the closure member or lid 96. I prefer to use an end member 22 on the outer edge of the drawer 101.

Continuing with FIG. 13, I utilize elongate members 109 on the upper surface of the pull-out drawer 101, in order to make it possible for the user to cause the writing surface 102 to be disposed at an appropriate angle for his or her purposes. The elongate members 109 are secured by screws, riveting, or by a suitable adhesive in an aligned relationship upon the upper surface of the member 101. On the upper surfaces of the members 109, a spaced series of protrusions are utilized. The protrusions of one member 109 are in alignment with the protrusions of the other member 109. These protrusions are high enough so that they can form a dependable support for the base portion of the U-shaped member 107 in whatever position is selected by the user. By making these protrusions of somewhat hook shape, the base of the U-shaped member 107 will not be easily dislodged from contact with the selected protrusion. As is obvious, there are a sufficient number of protrusions that the user is afforded a number of optional angular positions for the tiltable writing surface 102.

Figure 15:
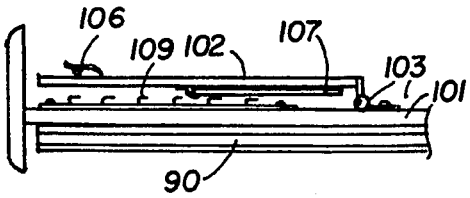
FIG. 15 is a cross sectional view depicting the tiltable writing surface in the folded condition.
Figure 14:
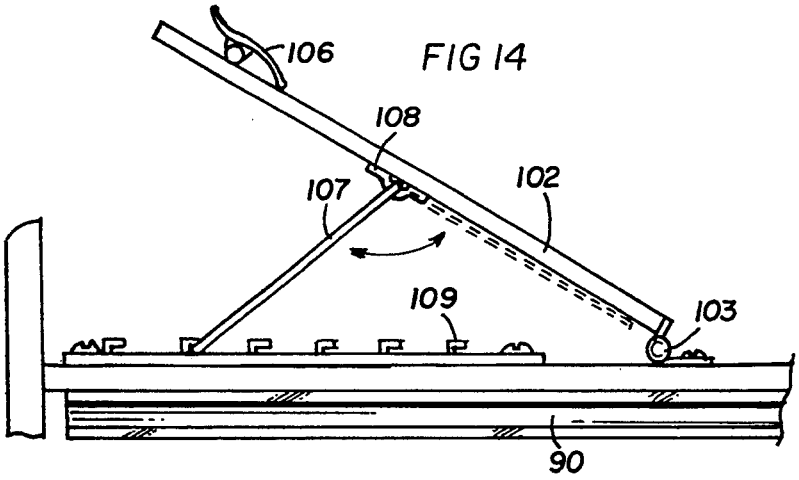
FIG. 14 is a somewhat enlarged view of the tiltable writing surface from one side, revealing additional detail.

In FIG. 14 I reveal a somewhat enlarged version of the tiltable writing surface 102, so that additional details of this aspect of my invention will be made apparent, whereas in FIG. 15 I show the relationship of the tiltable writing surface to the pull-out drawer 101 when the tiltable writing surface has been moved to the flattened condition for storage inside the closure member 96. It is to be noted that I provide ample clearance in the interior of the lid or closure member to receive the tiltable writing surface when moved into the folded condition depicted in FIG. 15.

Figure 16:
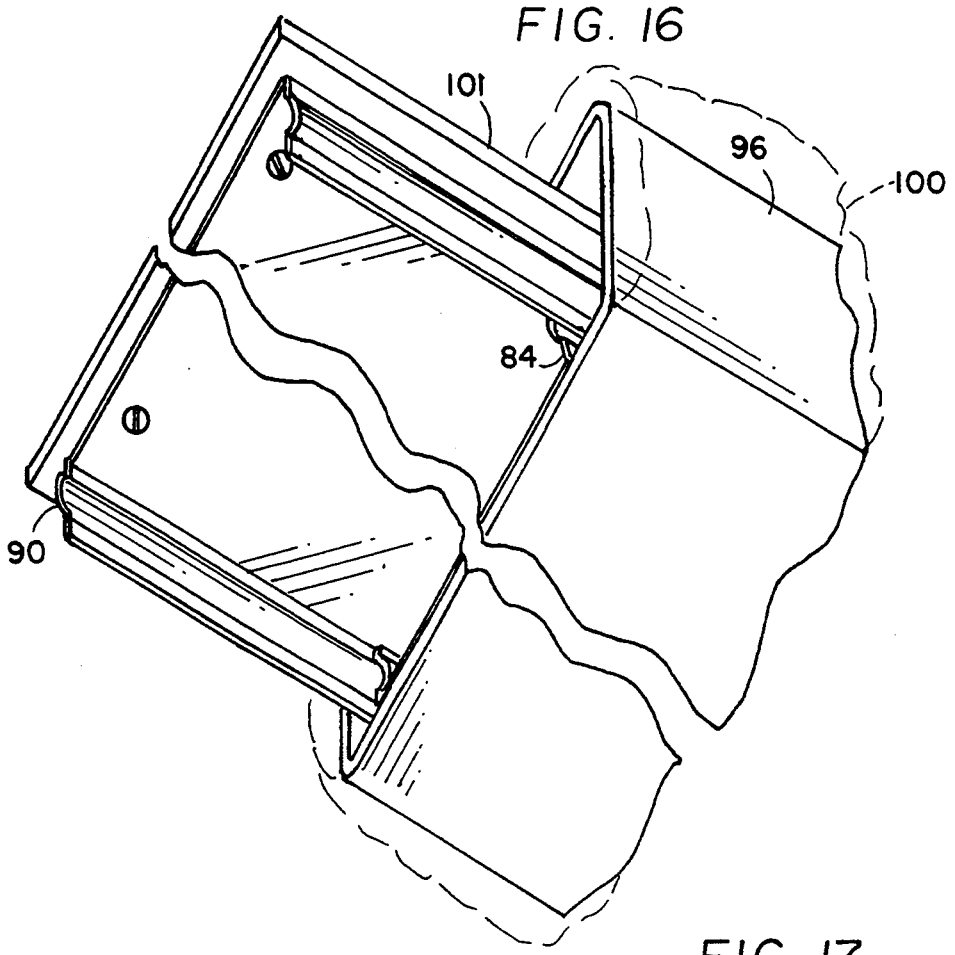
FIG. 16 is a perspective showing of the lid or cover member of the armrest, viewed from below to reveal support detail associated with the slidably mounted usable surface.
Figure 17:
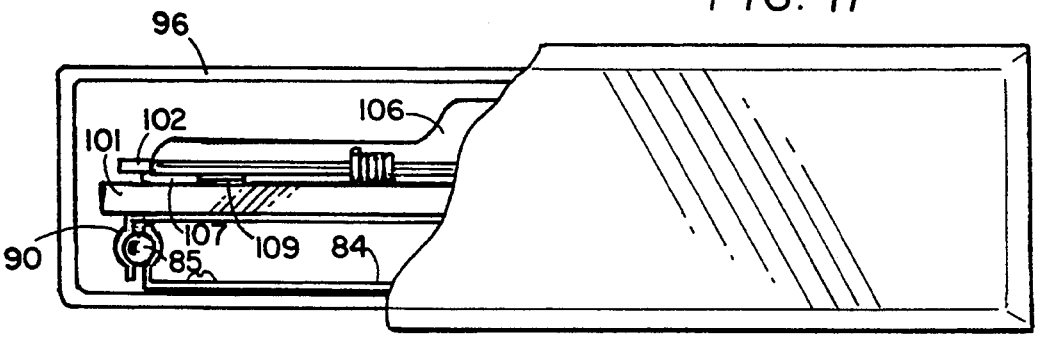
FIG. 17 is an end view, revealing additional aspects of the support arrangement provided for the slidably mounted usable member contained in the armrest.

In FIG. 16 I show a perspective view of the underside of the lid or cover member 96, in order to reveal the slidable support means that I prefer to use for the slidably mounted member 101. Although I am not limited to any particular configuration of slidable support means, I prefer to use a construction of the type depicted in FIG. 8, wherein rail members 90 are affixed, such as by small screws, along the centerline of the underside of the slidably mounted member 101. As in the case of FIG. 8, wherein inner rail members 84 are utilized, I prefer to use inner rail members 84 mounted on the bottom interior of the lid or cover member 96, placed in careful alignment with the rail members 90, and held in place by small screws; note FIG. 17. In order to minimize friction, I utilize a number of balls or spheres 85 between the inner rail members 84 and the outer rail members 90. Note that this detail as it appears in FIG. 17, bears a certain relationship to the showing of FIG. 8. This arrangement makes it possible for the user to readily pull the usable writing surface 101 out of the cover member or lid 96 when needed, and to return it to the interior of the member 96 when such use is complete.

Figure 18:
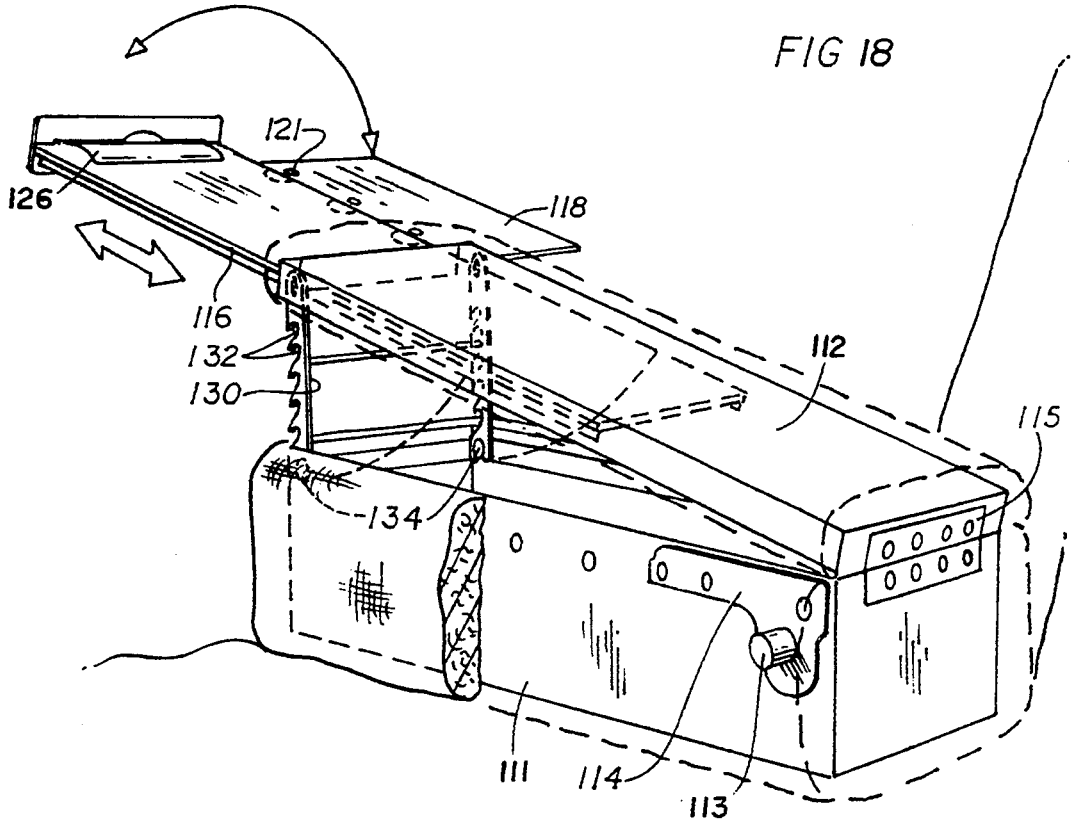
FIG. 18 is a perspective depiction of another embodiment of my invention, with the usable surface in its extended and supported position, this view revealing the manner in which the padded top serves both as a housing for the slidably mounted usable surface as well as a cover to the integral storage container.

In FIG. 18 I show a perspective view of another embodiment of my invention which, like certain previous embodiments, entails the use of a large compartment 111 serving as a storage means for a substantial number of items such as writing implements, sunglasses, a dictating device, a change purse, a device for scraping ice from the windshield, and the like.

A generally L-shaped member 114, generally comparable to the L-shaped member 34 of the first embodiment, is secured to the outer surface of the compartment 111, with the L-shaped member 114 supporting a pivot member 113 forming the pivotal support for one side of this embodiment of my armrest. As is obvious, a second L-shaped member and a second pivot member are utilized in an appropriately aligned relationship on the side of the armrest opposite the member 114, although such is not visible in this figure.

The outer surfaces of the compartment 111 are covered with padding for the comfort and safety of the passengers. The compartment 111 is closed on all sides except that the closure member 112 serves to open and close the access to the interior of the member 111, which is through the top.

Unlike the hinging arrangement shown in FIG. 12, in the embodiment shown in FIG. 18 I utilize a rear hinge 115, preferably a piano type hinge, to support the rearmost edge of the closure member 112.

It will be noted that the perspective depiction of this embodiment of my invention in its extended and supported position in FIG. 18 reveals the manner in which the padded top 112 serves both as a housing for the retracted writing surface as well as a cover to the integral storage container. Rotatable struts provide rigid support when the user wishes to utilize the writing surface 116 at an angle.

Contained on the underside of the closure member 112 are means forming a suitable support for the slidable drawer 116, which has an unencumbered upper surface insofar as its use for a writing surface is concerned. Because of the support arrangement used, the drawer 116 can be slid in and out from the inside underside of the closure member 112 at the behest of the person utilizing the device. As is obvious, the drawer can be slid fully out, or only partially out, depending on the particular need of the user. So as to give the user an increased amount of writing space, a secondary writing surface 118 may be hingedly mounted along one edge of the primary writing surface formed by drawer 116, with the outward movement of the secondary writing surface serving to essentially double the amount of writing area. Suitable means are used to cause the extended surface 118 to reside parallel to the surface 116.

Because I prefer to use a clip member 126 on the primary writing surface for securing a writing pad, the front edge of the secondary writing surface 118 typically does not extend as far forward as the primary writing surface, thus avoiding conflict with the clip member 126.

The hinge means 121 I use for supporting the secondary writing surface 118 are preferably mounted so as to permit a writing pad of some thickness to be utilized on the primary writing surface without the secondary writing surface being prevented from lying parallel to the surface of the primary writing surface, when moved to the closed or folded position.

It may be desirable for the user to change the angularity or upward inclination of the writing surfaces of FIG. 18, and to that end I utilize a pair of hinged members 130 that are pivotally mounted about their upper ends to the underside of the front portion of the closure member 112. It is to be noted that the pair of hinged members 130 may readily be swung from the deployed position illustrated by the use of full lines in FIG. 18, into the folded position, indicated by the use of dashed lines in this figure. With members 130 in the folded position, the writing surface may be moved to a flat condition. The pair of hinged members 130 reside on the underside of the closure member 112 when not in use, and may, if desired, be spring biased into that position.

The forwardmost edges of the pair of hinged members contain a spaced series of notches 132, arrayed in the manner revealed in FIG. 18, with there being provided a fixed protrusion 134 on each side of the inner front edge of the compartment 111, with the protrusions 134 being readily engaged by any of the notches utilized along the edges of the hinged members. As is obvious, the user selects the angularity at which the closure member 112 will be maintained, by causing a preferred pair of notches 132 of the members 130 to engage the fixed protrusions 134 on the front interior of the compartment 111.

Figure 19:
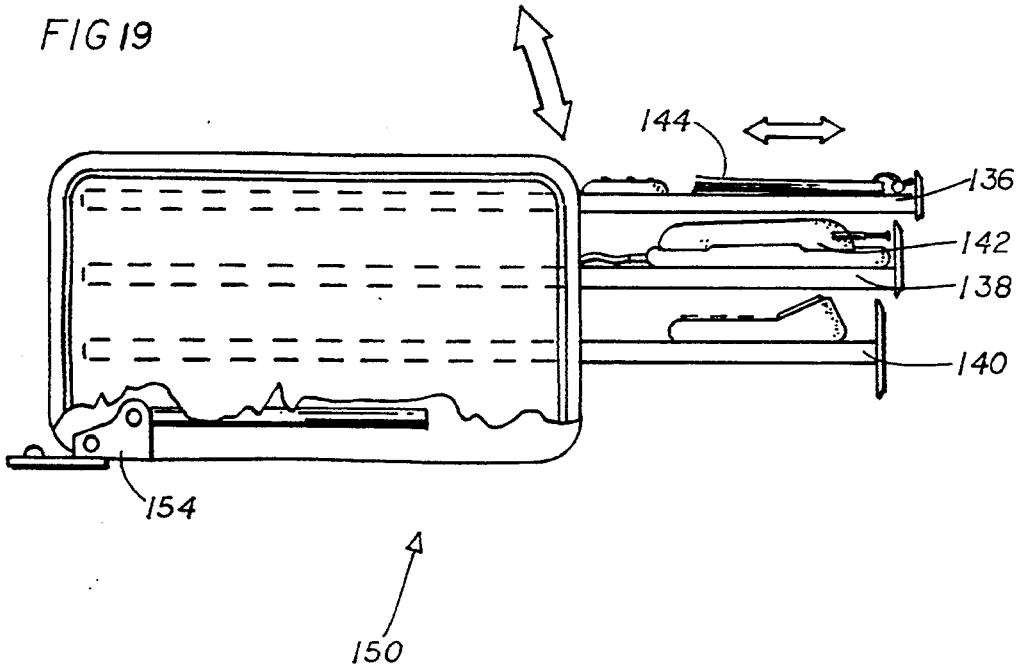
FIG. 19 is a side elevational view of another embodiment of my invention, incorporating a plurality of sliding retractable members to perform multiple functions, and with my novel armrest being supportable in several different angular positions by hinges of the typical "chaise lounge" type.

With reference now to FIG. 19, it will be noted that this is an elevational view of another armrest embodiment 150, incorporating a plurality of sliding retractable members to perform multiple functions. Here depicted are the top drawer 136, intended for use as the writing surface, which may also support a calculator or other small electronic device. The center drawer 138 may support a mobile telephone 142, and the lower drawer 140 may support a portable television, recording device or calculator. As was the case with certain of the earlier embodiments, the entire unit may be stopped and supported in several angular positions by hinges 154 of the typical "chaise lounge" type. It may be reset level by being raised through its multiple detents to a near vertical position, then lowered smoothly.

It will thus be seen in FIG. 19 that I am not limited to the use of an armrest having but a single sliding drawer, for as revealed in this figure, I may utilize an armrest containing three sliding drawers, each of which is selectively movable into and out of the armrest. In order to have unencumbered upper drawer surfaces, I utilize the slide out drawer supports on the underside of the drawers. Although all three drawers are shown in the extended position in FIG. 19 to enable explanation of their respective purposes, it is to be understood that normally only one drawer at a time is slid out of the armrest.

In this embodiment, the top drawer 136, as in previous instances, is typically utilized for holding and supporting a writing pad 144 for the convenience of the user, and this writing pad, as before, is preferably maintained in the desired position by the use of a spring biased clip member.

Although I am in no way limited to any certain or particular use for the middle drawer 138, I can, as mentioned hereinabove, utilize the middle drawer for supporting a cordless telephone 142, typically a cellular telephone, the antenna of which is visible in FIG. 19.

Lastly, the bottom drawer 140 can be utilized for still a different purpose, such as a calculator or tape recording device utilized for business reasons, or for the entertainment of the user. As mentioned previously, these drawers are in the extended position only for the purpose of facilitating the mentioning of exemplary purposes to which each drawer may be put, and it is to be understood that depending on the whim of the user, any one of several different devices can be selected for utilization on, or supported by, each drawer. The drawers can also be used for storage of valuables, or for certain tools.

With further regard to the hinges 154 utilized at the lower left hand corner of the armrest illustrated in FIG. 19, I prefer for these hinges to be of the type utilizing teeth along one part or portion of each hinge half, with the teeth of the two hinge halves being in engagement during normal use of the device. This type of hinge has the characteristic of causing the armrest to be supportable in any one of a number of selected positions or angles of inclination.

Figure 20:
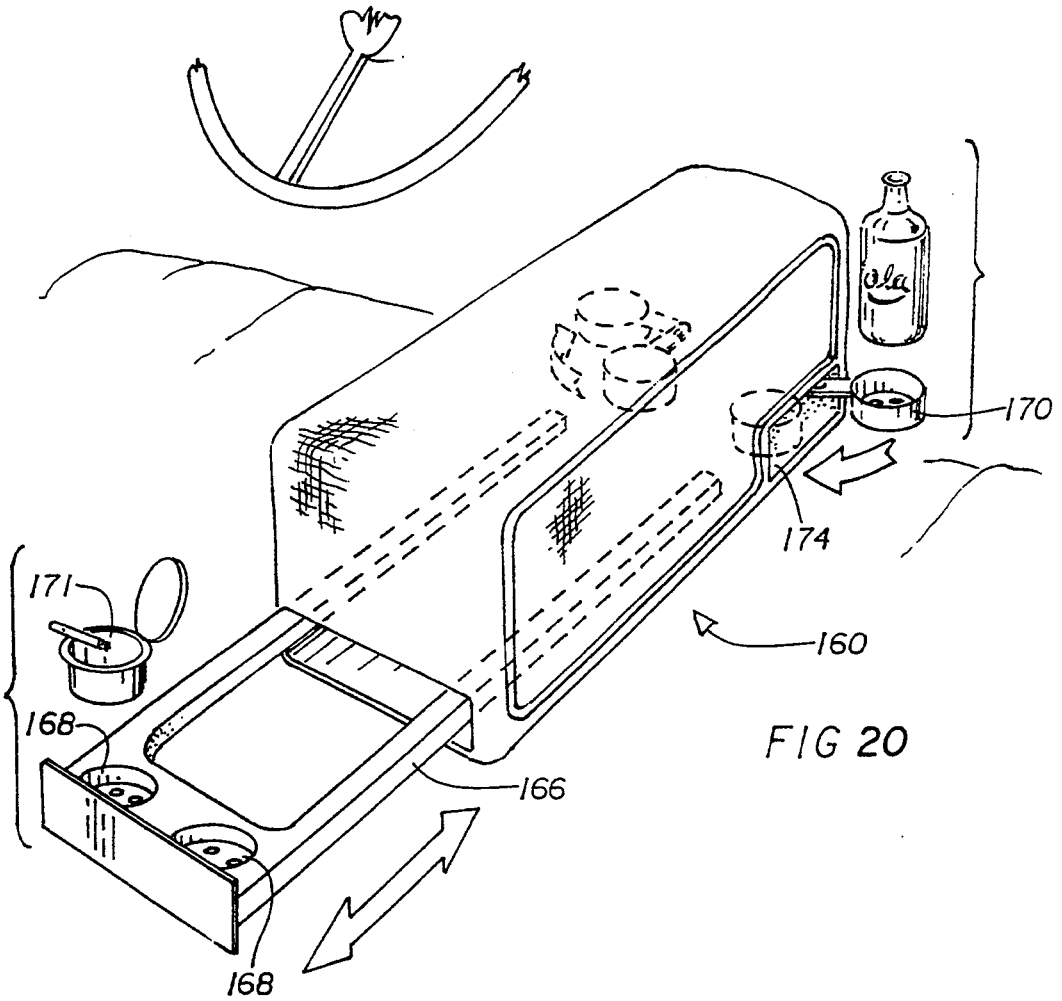
FIG. 20, from which retractable members are omitted for clarity, is a perspective view revealing how I may incorporate a sliding multipurpose holder at the rear of certain armrest embodiments, and how I may use drink holders at either side of the front of the device.

Turning now to FIG. 20, it will be seen that the retractable members or drawers are omitted for reasons of clarity from this embodiment 160 of my invention. This perspective view of armrest 160 reveals how I can incorporate a sliding multipurpose holder at the rear of any embodiment of the device, and use swivelling multipurpose holders at either side of the front of the device. These holders may be sized to accommodate a standard soda bottle, such as of 16 ounce capacity. I have conceived these holders as being molded of plastic. A tapered metallic ashtray may be positioned to suit, and is designed to avoid side and bottom contact with the plastic holder.

It will also be noted in FIG. 20 that I have depicted the rear edge of the armrest 160, so as to reveal the utilization therein of an elongate, relatively narrow drawer 166. This drawer is slidably mounted, and is movable in the rearward direction for the use of the passenger or passengers sitting in the rear seat of the automobile.

In the rearmost or outwardmost portion of the drawer 166, one or more apertures or recesses 168 are provided for receiving beverages, for example, although one of the holes or apertures could be used as an ashtray 171, and the other one used for receiving a bottle, can, cup or glass.

It is to be understood that the armrest 160 can be of comparatively shallow overall depth, containing only the rearwardly directed drawer 166, but more typically there will also be one or more forwardly directed drawers, such as of the type described at some length hereinabove.

Somewhat similarly, I may utilize hingedly mounted drink supporting devices 170 at the front corners of the armrest 160, as also depicted in FIG. 20. As will be understood, the drink supporting devices utilized at the front of the armrest are each typically mounted adjacent a respective recess 174, into which the supporting device can be moved at the time the bottle, can or cup has been removed therefrom. It is important to note that when a bottle, can or cup is supported in the pivotally mounted support device, it is not positioned such as to interfere with the operation of the slidably mounted drawers.

It is to be realized that with both the devices used in the drawer as well as in the pivotally mounted supporting means, I can arrange for the acceptance therein of two or more different sizes of cups, glasses or containers.

Figure 21:
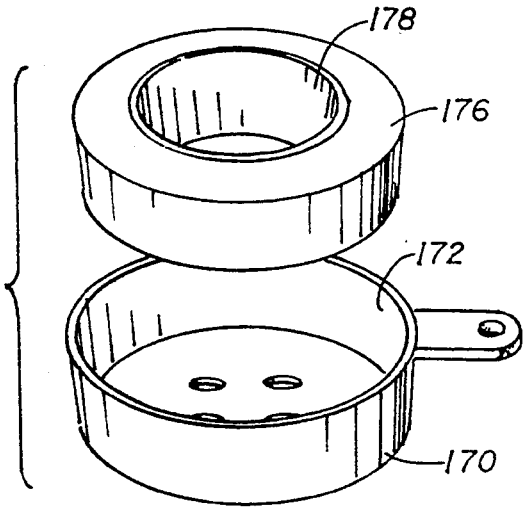
FIG. 21 is a perspective view revealing how an insulating foam ring with integral plastic sleeve fits into a comparatively large plastic holder, so as to be a proper size for receiving a glass or can.

As depicted in FIG. 21, the basic hingedly mounted device 170 has an inner diameter 172 sufficient to receive a fairly large cup or bottle, which may be larger than desirable when my device is being used in connection with a can, or a cup of a standard size. Accordingly, I provide as shown in FIG. 21 a toroidally shaped device 176 sized to fit into the pivotally mounted supporting device 170.

As an example of preferred construction, the device 176 may be made of foam plastic, with its external diameter being such as to snugly engage the inner surfaces of the supporting device. The inner diameter 178 of the toroidally shaped member 176 is typically the size of a can, such as contains beer or a soft drink, with the result being that the can or cup placed inside the toroidally shaped member will not slide from side to side in the supporting device 170, in the event the driver is traversing winding or mountainous roads. An integral plastic sleeve liner 180 may be used in the central portion of the member 176 in order to prevent snagging friction between the foam ring and a beverage container.

As will be obvious, in the event the rearwardly directed drawer 166 is utilized in an armrest that can be tilted, it will be necessary for the user to move the drawer into the closed or recessed position before the armrest will be able to be tilted.

Figure 22:
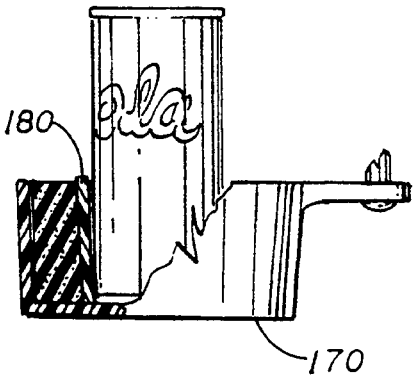
FIG. 22 reveals in cutaway and section the manner in which the composite ring of FIG. 18 is sized to snugly accommodate a standard 12 oz. beverage can.

FIG. 22 reveals in cutaway and section the manner in which the composite ring of FIG. 21 is sized to accommodate a standard 12 oz. beverage can.

As should now be apparent with regard to the usable surface utilized in conjunction with an armrest, this usable surface is slidably mounted in a manner enabling it to be withdrawn from an aperture located in the front of the armrest, and thereafter returned at the user's behest to the retracted location in the armrest. Importantly, I provide a usable surface residing at an angle convenient for use as a writing surface, and this surface is unimpaired for such use by virtue of the slidable support means being confined to the underside of the usable surface.

Because of the size of the aperture in the front of the armrest, and the advantageous slidable mounting arrangement I use for the usable surface, a writing pad or tablet removably attached to the usable surface can remain in place at the time the usable surface is being returned to the retracted location.

As should also be apparent, the usable surface may either be contained in the armrest itself, or alternatively it may be mounted in the lid or closure member of an embodiment utilizing a storage container in the interior of the armrest.

Although I have shown a number of different embodiments of my invention, it is to be understood that I am not to be limited to any one configuration, except as may be required by the scope of the appended claims.

I claim:

1. An armrest provided with a writing surface for a seated user, said armrest being of narrow, elongate construction and having a rear end as well as a front end and an upper portion, said armrest also having an interior portion, an aperture disposed in an upper portion of the front end of said armrest and disposed in contact with the interior portion of said armrest, a usable surface having a front and rear end of elongate configuration operatively disposed in the interior of said armrest, means slidably supporting said usable surface in a manner enabling said usable surface to be slidably withdrawn from the interior of said armrest through said aperture in the front end of said armrest, and thereafter returned by a user to a retracted location in the interior of said armrest, the front end of said usable surface being disposed higher than the rear end thereof, such usable surface thus defining a writing surface disposed at a convenient angle, said usable surface being provided on its underside with slidable support means, said usable surface thus being unimpaired as a writing surface by virtue of said slidable means being located on its underside, said usable surface having means thereon by which a writing pad can be removably attached to said surface, said aperture being sufficiently large as to make possible a writing pad remaining on said usable surface when the usable surface is to be returned to the retracted location in the armrest.

2. The armrest as recited in claim 1 in which said armrest is pivotably mounted upon pivotal mounting means provided at the rear end of said armrest, such pivotal mounting means enabling the tilting of the armrest by a user.

3. An armrest provided with a writing surface for a seated user, said armrest being of narrow, elongate construction and having a rear end as well as a front end and an upper portion, a usable surface of elongate configuration disposed in said upper portion of said armrest, means slidably supporting said usable surface in a manner enabling said usable surface to be slidably withdrawn from said front end of said armrest, and thereafter to be returned by a user to a retracted location in the interior of said armrest, said usable surface being provided on its underside with slidable support means, such usable surface thus defining a writing surface, such surface being unimpaired as a writing surface by virtue of said slidable means being located on its underside, a tiltable writing surface hingedly mounted on said usable surface, said tiltable writing surface having means thereon by which a writing pad can be removably attached to said tiltable writing surface.

4. The armrest provided with a writing surface as recited in claim 3 in which means are provided for supporting said tiltable writing surface in an angular relationship to said usable surface said means for supporting said tiltable writing surface enabling the user to select an angle at which a writing pad can be maintained.

5. The armrest provided with a writing surface as recited in claim 4 in which said tiltable mounting surface has an underside, and said means for supporting said tiltable writing surface is a member hingedly mounted on such underside.

6. The armrest provided with a writing surface as recited in claim 3 in which beverage supporting means is located near the front end of said armrest.

7. The armrest provided with a writing surface as recited in claim 3 in which beverage supporting means is located near the rear end of said armrest.

8. The armrest provided with a writing surface as defined in claim 3 in which said usable surface is one of a plurality of members longitudinally slidable out of said armrest, with others of such members serving as mounting means for components of further assistance to the user of the armrest.

9. An armrest provided with a writing surface for a seated user, said armrest being of narrow, elongate construction and having a rear end as well as a front end and an upper portion, said armrest defining in its interior a storage container, said storage container having a top opening that is equipped with a lid of elongate configuration, hinge means for supporting said lid, said lid having long side edges as well as a front end, with an interior in which is disposed an elongate usable surface capable of being utilized for supporting writing material, means slidably supporting said usable surface in a manner enabling said usable surface to be slidably withdrawn from said front end of said lid by the user, and thereafter to be returned to a retracted location in the interior of said lid by the user, said usable surface serving as a writing surface for the seated user, said surface being unimpaired as a writing surface by virtue of said slidable means being located on the underside of said usable surface, whereby upon said usable surface being slidably withdrawn from said lid of said armrest, a writing tablet can be utilized upon said usable surface.

10. The armrest provided with a writing surface as recited in claim 9 in which a tiltable writing surface is hingedly mounted on said usable surface, said tiltable writing surface having means thereon by which a writing pad can be removably attached to said tiltable writing surface.

11. The armrest provided with a writing surface as recited in claim 10 in which means are provided for supporting said tiltable writing surface in an angular relationship to said usable surface, said means for supporting said tiltable writing surface enabling the user to select the particular angle at which a writing pad can be maintained.

12. The armrest provided with a writing surface as recited in claim 9 in which said hinge means for supporting said lid is located along one of its long side edges, said lid, when lifted, giving the user access to said storage container.

13. The armrest provided with a writing surface as recited in claim 9 in which said lid has a rear surface opposite its front end, said hinge means for supporting said lid being located at its rear surface.

14. The armrest provided with a writing surface as defined in claim 13 in which said usable surface forming a component of the lid of said storage container is comprised of first and second parts, with said second part hingedly mounted upon said first part, the hinge means being disposed laterally on one side of said first part of said usable surface, on a side away from the user of the armrest, whereby the user can extend the effective width of said usable surface by lifting the free edge of the second part, and moving it away from him.

15. A tiltable armrest of narrow, elongate construction, and providing therein a writing surface capable of being readily utilized by a seated user, said armrest having a rear end as well as a front end, and also having an upper portion as well as a lower portion, a pivotal support adjacent the lower portion of said armrest, near said rear end thereof, enabling said armrest to be pivoted upwardly on occasion, said armrest defining an interior storage container having a top opening, with a hinged lid serving as a cover for said storage container, hinge means supporting said lid such that on occasion it can be raised to grant the user access to said storage container, said lid having long side edges and a front end in which an opening is provided, said lid having an interior portion accessed by such opening, a usable surface of elongate configuration slidably mounted in the interior of said lid, said usable surface being able to be slidably withdrawn through the opening in the front end of said lid, said usable surface having an upper portion clear of any support means, said usable surface defining a writing surface, with such surface being available for the placement thereon of writing material, said usable surface having slidable support means located on an underside thereof, for enabling the usable surface to be slidably withdrawn from said front end of said lid by a user, means adjacent a forward end of said upper portion upon which writing material can be attached in a usable position, whereby upon said usable surface being slidably withdrawn from said lid of said armrest, writing material can be utilized without any interference from any component or aspect of said support means.

16. The tiltable armrest as recited in claim 15 in which a tiltable writing surface is hingedly mounted on said usable surface, said tiltable writing surface having means thereon by which a writing pad can be removably attached to said tiltable writing surface.

17. The tiltable armrest as recited in claim 16 in which means are provided for supporting said tiltable writing surface in an angular relationship to said usable surface, said means enabling the user to select an angle at which a writing pad can be maintained.

18. The tiltable armrest as recited in claim 15 in which said hinge means is disposed along one of said long side edges of said lid.

19. The tiltable armrest as recited in claim 15 in which said lid has a rear surface opposite its front surface, said hinge means being located at its rear surface.

20. The tiltable armrest as defined in claim 19 in which said usable surface forming a component of the lid of said storage container is comprised of first and second parts, with said second part hingedly mounted upon said first part, the hinge means being disposed laterally on one side of said first part of said usable surface, on a side away from the user of the armrest, whereby the user can extend the effective width of said usable surface by lifting the free edge of the second part, and moving it away from him.

21. The armrest provided with a writing surface as recited in claim 15 in which beverage supporting means is located near the front end of said armrest.

22. The armrest provided with a writing surface as recited in claim 15 in which beverage supporting means is located near the rear end of said armrest.

23. An armrest provided with an extensible-retractable writing surface for a seated user, said armrest being of narrow, elongate construction, and having a rear end as well as a front end and an upper portion, said armrest also having an interior portion, an aperture disposed in an upper portion of the front end of said armrest and disposed in contact with the interior portion of said armrest, a writing surface having a front and rear end, said writing surface being of relatively rigid, elongate configuration operatively disposed in the interior of said armrest, means slidably supporting said writing surface in a manner enabling said surface to be slidably withdrawn from the interior of said armrest through said aperture in the front end of said armrest, and thereafter returned by a user to a retracted location in the interior of said armrest, the front end of said writing surface being disposed higher than the rear end thereof, thus presenting a writing surface that resides at an angle convenient for use by the seated user, said writing surface being provided on its underside with slidable support means, said writing surface thus being unimpaired as a surface upon which to write by virtue of said slidable means being located on its underside, said usable writing surface having means thereon by which a writing pad can be removably attached to said surface.

24. The armrest as recited in claim 23 in which said aperture is sufficiently large as to make possible a writing pad remaining on said writing surface at the time said writing surface is to be returned to the retracted location in the armrest.

25. The armrest as recited in claim 23 in which said armrest is pivotally mounted upon pivotal mounting means provided at the rear end of said armrest, such pivotal mounting means enabling the tilting of the armrest by a user.

26. An armrest provided with a writing surface for a seated user, said armrest being of narrow, elongate construction and having a rear end as well as a front end and an upper portion, a writing surface of elongate configuration disposed in said upper portion of said armrest, means slidably supporting said writing surface in a manner enabling said surface to be slidably withdrawn from said front end of said armrest, and thereafter to be returned by a user to a retracted location in an interior of said armrest, said writing surface being provided on its underside with slidable support means, such surface thus being unimpaired as a writing surface by virtue of said slidable means being located on its the underside of said writing surface, said writing surface being hingedly mounted so as to be tiltable, said tiltable writing surface having means thereon by which a writing pad can be removably attached to said tiltable writing surface.

27. The armrest provided with a writing surface as recited in claim 26 in which means are provided for supporting said tiltable writing surface in an angular relationship to said usable surface, said means for supporting said tiltable writing surface enabling the user to select an angle at which a writing pad can be maintained.

* * * * *